US009446873B2

(12) United States Patent
Haschke et al.

(10) Patent No.: US 9,446,873 B2
(45) Date of Patent: Sep. 20, 2016

(54) POULTRY LOADER WITH ALIGNMENT MECHANISM

(71) Applicants: Eggo Haschke, Deerfield, IL (US); Martin Zurwieden, Sassenberg (DE)

(72) Inventors: Eggo Haschke, Deerfield, IL (US); Martin Zurwieden, Sassenberg (DE)

(73) Assignee: Precitec Corp., Mundelein, IL (US)

( * ) Notice: Subject to any disclaimer, the term of this patent is extended or adjusted under 35 U.S.C. 154(b) by 569 days.

(21) Appl. No.: 13/836,601

(22) Filed: Mar. 15, 2013

(65) Prior Publication Data

US 2014/0182249 A1 Jul. 3, 2014

Related U.S. Application Data

(60) Provisional application No. 61/624,720, filed on Apr. 16, 2012.

(51) Int. Cl.
*B65B 5/00* (2006.01)
*B65B 43/26* (2006.01)
(Continued)

(52) U.S. Cl.
CPC ..... *B65B 43/42* (2013.01); *B65B 1/04* (2013.01); *B65B 5/00* (2013.01); *B65B 5/045* (2013.01); *B65B 17/00* (2013.01); *B65B 25/064* (2013.01);
(Continued)

(58) Field of Classification Search
CPC ..... B65B 25/064; B65B 43/36; B65B 5/045; B65B 51/04; B65B 31/046; B65B 43/26; B65B 51/046; B65B 67/04; B65B 51/043; A22C 21/00; A22C 17/0093
USPC ..... 53/138.1–138.8, 255, 258, 381.1, 53/382.1, 384.1, 385.1, 386.1
See application file for complete search history.

(56) References Cited

U.S. PATENT DOCUMENTS 2,901,875 A * 9/1959 Hultkrans ..... B65B 25/064 141/312
3,254,472 A * 6/1966 Clark ..... B65B 25/064 53/259

(Continued)

FOREIGN PATENT DOCUMENTS

DE 29603999 U1 * 4/1996 ..... B65B 5/045

OTHER PUBLICATIONS

Translation of DE 296 03 999, Jan. 26, 2016.*

*Primary Examiner* — Gloria R Weeks
*Assistant Examiner* — Eyamindae Jallow
(74) *Attorney, Agent, or Firm* — Fitch, Even, Tabin & Flannery LLP

(57) ABSTRACT

An improved loader is described. The loader includes a frame having an upper surface, a pair of horns adjustably connected to the upper surface, each horn comprising an upper shoulder, a lower shoulder, and an air duct between the upper shoulder and the lower shoulder, a pair of air hoses connecting each air duet to a controller, the controller being connected to a pressurized air supply, and an alignment mechanism mounted, the alignment mechanism including an axle mounted to the frame, a first arm connected to a first panel, the first arm rotatably connected to the axle, a second arm connected to a second panel, the second arm rotatably connected to the axle, a gear mechanism connected to the axle and to the first arm and the second arm, the gear mechanism configured to rotate the second arm in a direction opposite to a direction of rotation of the first arm, and a dual-action cylinder connected to at least one of the first arm and the second arm.

20 Claims, 10 Drawing Sheets

(51) Int. Cl.

| | |
|---|---|
| ***B65B 43/42*** | (2006.01) |
| ***B65B 1/04*** | (2006.01) |
| ***B65B 5/04*** | (2006.01) |
| ***B65B 17/00*** | (2006.01) |
| ***B65B 25/06*** | (2006.01) |
| ***B65B 43/36*** | (2006.01) |
| ***B65B 65/00*** | (2006.01) |
| *B65B 51/04* | (2006.01) |

(52) U.S. Cl.
CPC ..... *B65B 43/36* (2013.01); *B65B 65/00* (2013.01); *B65B 51/043* (2013.01)

(56) References Cited

U.S. PATENT DOCUMENTS 3,621,891 A * 11/1971 Eisenberg ..... B65B 1/363 141/1
4,033,088 A * 7/1977 Markert ..... B65B 5/045 53/473
4,221,106 A * 9/1980 Altenpohl ..... B65B 25/064 53/258
4,245,453 A * 1/1981 Altenophl ..... B65B 25/064 53/258
4,270,336 A * 6/1981 Altenpohl ..... B65B 25/064 198/358
4,352,263 A * 10/1982 Andrews, Jr. ..... B65B 5/045 53/258
5,048,266 A * 9/1991 Wieckowicz ..... B65B 43/26 53/385.1
6,199,351 B1 * 3/2001 Mount ..... B65B 1/02 53/386.1
2009/0233778 A1 * 9/2009 Tsutsui ..... B65B 3/02 493/212
2011/0232238 A1 * 9/2011 May ..... A22C 21/00 53/473
2013/0247511 A1 * 9/2013 Haschke ..... B65B 35/00 53/235
2013/0247512 A1 * 9/2013 Haschke ..... B65B 37/00 53/235

* cited by examiner

POULTRY LOADER WITH ALIGNMENT MECHANISM

PRIORITY

This application claims priority from U.S. Provisional Patent Application No. 61/624,720, filed Apr. 16, 2012, the disclosure of which is incorporated herein in its entirety.

FIELD OF THE INVENTION

The present invention relates generally to devices for loading material into bags. The invention relates more specifically to devices for loading whole dressed poultry into plastic bags.

BACKGROUND OF THE INVENTION

Automated loaders are commonly used to place material in packaging for storage, transport, or sale. For example, in a conventional poultry loader, a plastic bag is opened, sometimes by air and sometimes by mechanical means, such as a pair of horns. A whole dressed chicken is then pushed into the bag, sometimes manually, sometimes by gravity, sometimes by a ram. The bagged chicken is then sealed within the bag. Conventionally, the bag is clipped and the tail is severed. In some cases, prior to clipping, the air in the bag is evacuated. In other cases, the bag is shrunk by heat.

Chickens being bagged in this manner are not uniform in shape or size. A chicken sliding into a bag by gravity might turn as it slides. The placement of chickens in front of the ram is not necessarily uniform. Accordingly, a particular chicken may not stay on a straight line as it is pushed into the bag. If the chicken veers to one side as it is pushed into the bag, it might tear the bag, or it might not proceed entirely into the bag, leaving, for example, a leg sticking out of the bag, any of which situations cause a delay on the production line. Additionally, the chicken could turn sideways, and even if it is bagged, clipped, and sealed, the improper orientation will likely cause problems in transport and in marketing of the chicken.

The present invention addresses some of the problems of the prior art.

SUMMARY OF THE INVENTION

An improved loader has an adjustable alignment mechanism to keep material in alignment as it is loaded into a bag. The loader includes a frame having an upper surface, a pair of horns adjustably connected to the upper surface, each horn comprising an upper shoulder, a lower shoulder, and an air duct between the upper shoulder and the lower shoulder, a pair of air hoses connecting each air duct to a controller, the controller being connected to a pressurized air supply, and an alignment mechanism mounted to the frame, the alignment mechanism including an axle, a first arm connected to a first panel, a second arm connected to a second panel, the second arm rotatably connected to the first arm at the axle, a gear mechanism connected to the axle, the first arm, and the second arm, the gear mechanism configured to rotate the second arm in a direction opposite to a direction of rotation of the first arm, and a dual-action cylinder connected to at least one of the first arm and the second arm.

A BRIEF DESCRIPTION OF THE DRAWINGS

The organization and manner of the structure and operation of the invention, together with further objects and advantages thereof, may best be understood by reference to the following description, taken in connection with the accompanying non-scale drawings, wherein like reference numerals identify like elements in which.

DETAILED DESCRIPTION OF THE ILLUSTRATED EMBODIMENTS

Figure 1:
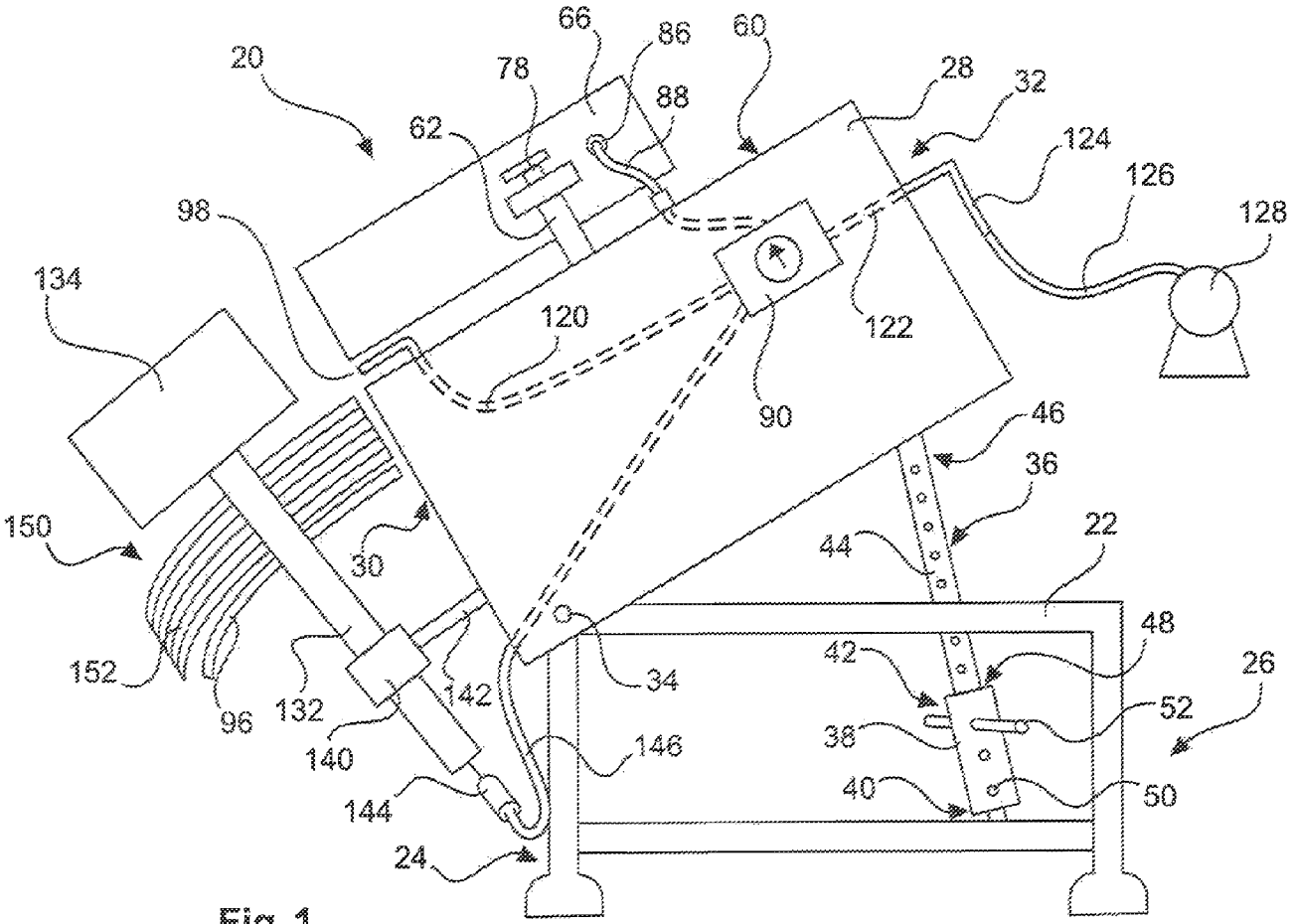
FIG. 1 is a schematic drawing of the poultry loader of the preferred embodiment of the present invention.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein. The embodiments of the present invention will be described as part of an automated poultry loader. The present invention, however, can also be used for loading any other materials in which proper alignment of the material is necessary or desired.

Figure 2:
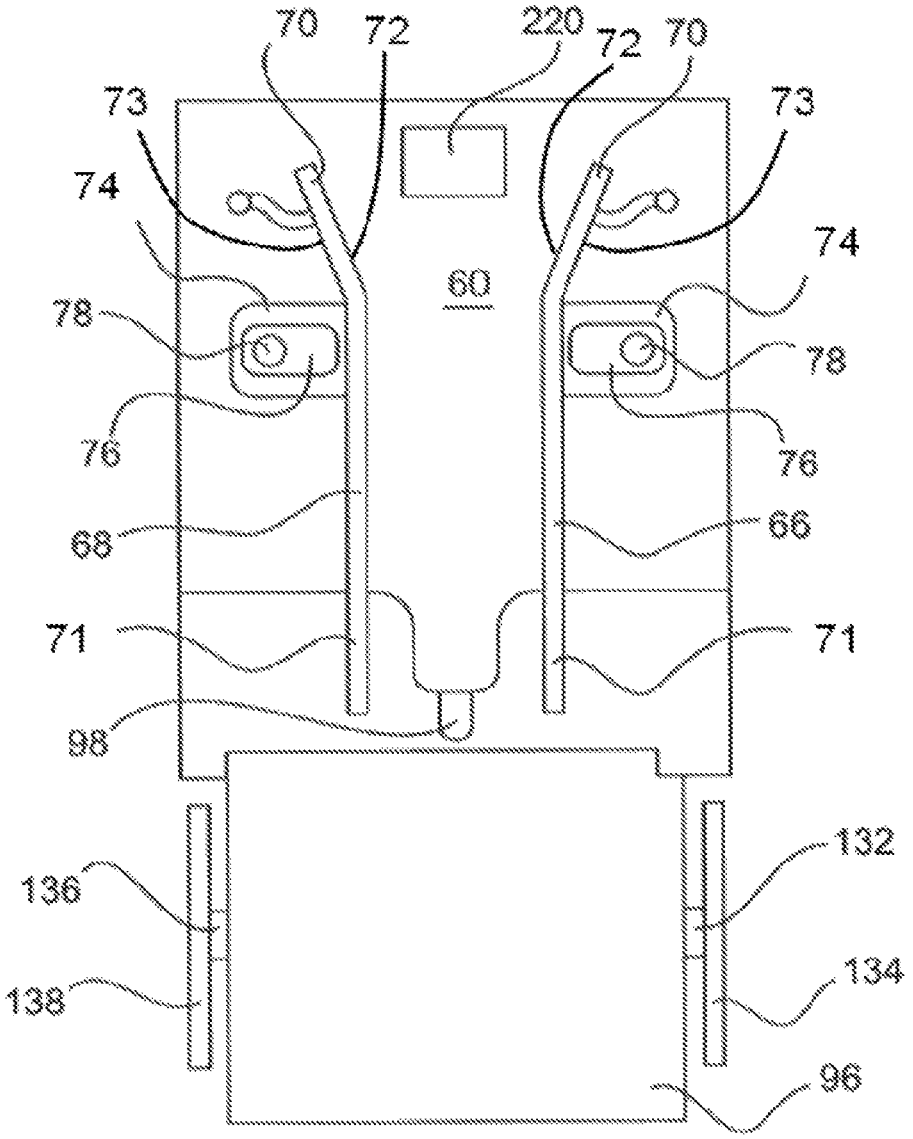
FIG. 2 is a top view of the poultry loader of FIG. 1.

A poultry loader 20 of the preferred embodiment of the present invention is shown in elevation schematic view in FIG. 1 and in top plan view in FIG. 2. Loader 20 has a lower frame 22 with a first end 24 and a second end 26, and an upper frame 28 with a first end 30 and a second end 32. Lower frame first end 24 connects to upper frame first end 30 at rotating attachment 34. Attachment 34 can be an axle, a pair of bolts, or any other mechanism that allows upper frame 24 to articulate with respect to lower frame 22. In another aspect of the invention, loader 20 has a single frame and upper frame 28 does not articulate with respect to lower frame 22.

A height adjustor 36 comprises an outer telescopic arm 38 having a first end 40 and a second end 42, and an inner telescopic arm 44 having a first end 46 and a second end 48. First end 40 is connected to second end 26 of lower frame 22 by a bolt, pin, or similar attachment means. First end 46 is connected to second end 32 of upper frame 28 by a bolt, pin, or similar attachment. Outer telescopic arm 38 is preferably a hollow tube with a bore configured to receive inner telescopic arm 44 within the bore. Both outer telescopic arm 38 and inner telescopic arm 44 have a plurality of apertures 50. A pin 52 is configured to engage apertures 50. Outer telescopic arm 38 and inner telescopic arm 44 are preferably tubes with circular cross-sections, but can alternatively be flat stock, angled stock, or tubes with other cross-sections, including by way of examples only oval or rectangular.

Upper frame 28 has a top surface 60, two pivots 62 protruding from the top surface 60, and two horns 66, 68 connected to pivots 62 respectively. Each horn 66, 68 has a distal portion 70 extending toward second end 32 and a proximal portion 71 extending toward first end 30. Each horn 66, 68 has an inner surface 72 facing toward the other horn and an outer surface 73 facing the opposite direction from inner surface 72. Each horn 66, 68 has an adjustment tab 74 projecting out from outer surface 73. Each tab 74 has an elongated aperture 76. A bolt 78 attaches each tab 74 to pivots 62. Each horn 66, 68 can be adjusted by moving horns 66, 68 closer together or farther apart by loosening bolt 78, moving the horn to the appropriate location, and tightening bolt 78. Similarly, the orientation of horns 66, 68 can be adjusted in the same manner, so place proximal portion 71 of each horn 66, 68 closer together or farther apart or to place distal portion 70 of each horn 66, 68 closer together or further apart.

Figure 3:
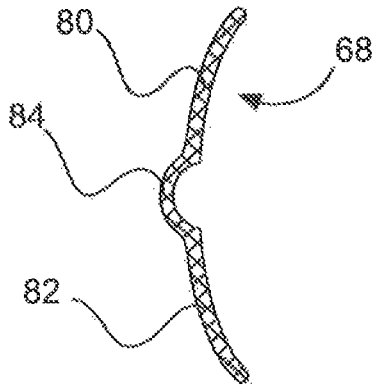
FIG. 3 is a cross-sectional view of a horn of the poultry loader of FIG. 1.

Horn 68 is shown in cross-section in FIG. 3. Horn 66 is the mirror image of horn 68 so only one is shown in this drawing. Each horn 66, 68 has an upper shoulder 80, a lower shoulder 82, and a half-arcuate duct 84 between upper shoulder 80 and lower shoulder 82. Each duct 84 has an air duct connector 86 at the distal portion 70. A pair of horn air feed hoses 88 run from each air duct connector 86 to a controller 90.

Upper frame 28 also has a bag plate 96 and an air jet 98. Bag plate 96 is in a plane generally parallel to the plane of top surface 60 and projects from first end 30. Air jet 98 is located just below top surface 60 at first end 30 and above bag plate 96.

Air jet 86 is connected to controller 90 by air jet feed hose 120. Controller 90 is connected by inner feed hose 122 to air filter 124. Outer feed hose 126 connects air filter 124 to pressurized air supply 128.

Figure 6:
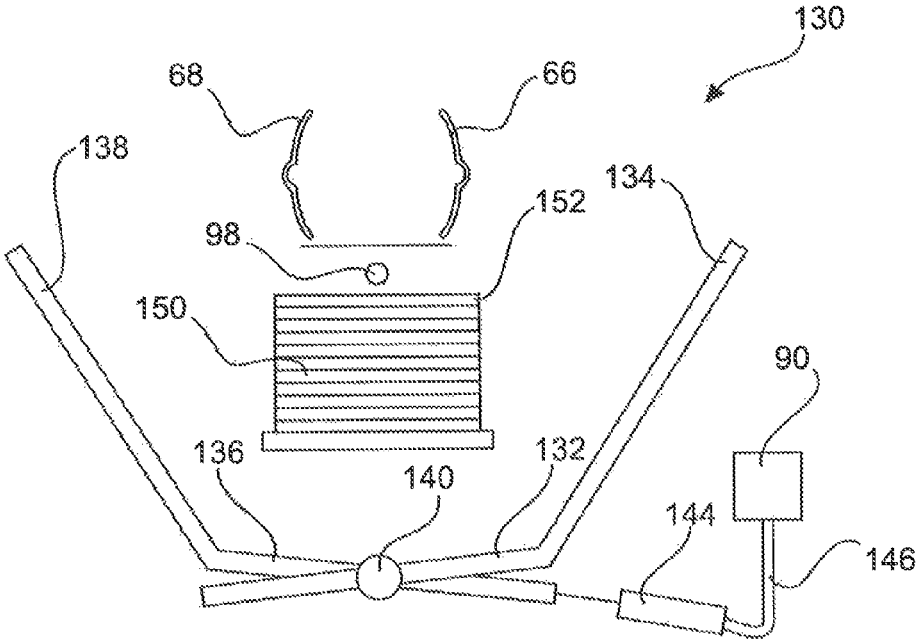
FIG. 6 is a from schematic view of the alignment mechanism of the poultry loader of FIG. 1 in a first position.

Alignment mechanism 130 comprises a first arm 132 connected to a first panel 134 and a second arm 136 connected to a second panel 138. First arm 132 and second arm 136 are rotatably connected to axle 140, which is mounted to upper frame 28 by strut 142. Strut 142 extends proximally from first end 30, below bag plate 96. An air cylinder 144 is connected to one of first arm 132 and second arm 136 (as illustrated in FIG. 6, to second arm 136). Air cylinder 144 is connected by alignment air feed hose 146 to controller 90. Air cylinder 144 is a dual-action cylinder and alignment air feed hose has two lumens for delivery of air to air cylinder 144, allowing controller 90 to cause air cylinder 144 to stroke in both a forward and a reverse direction.

Figure 6A:
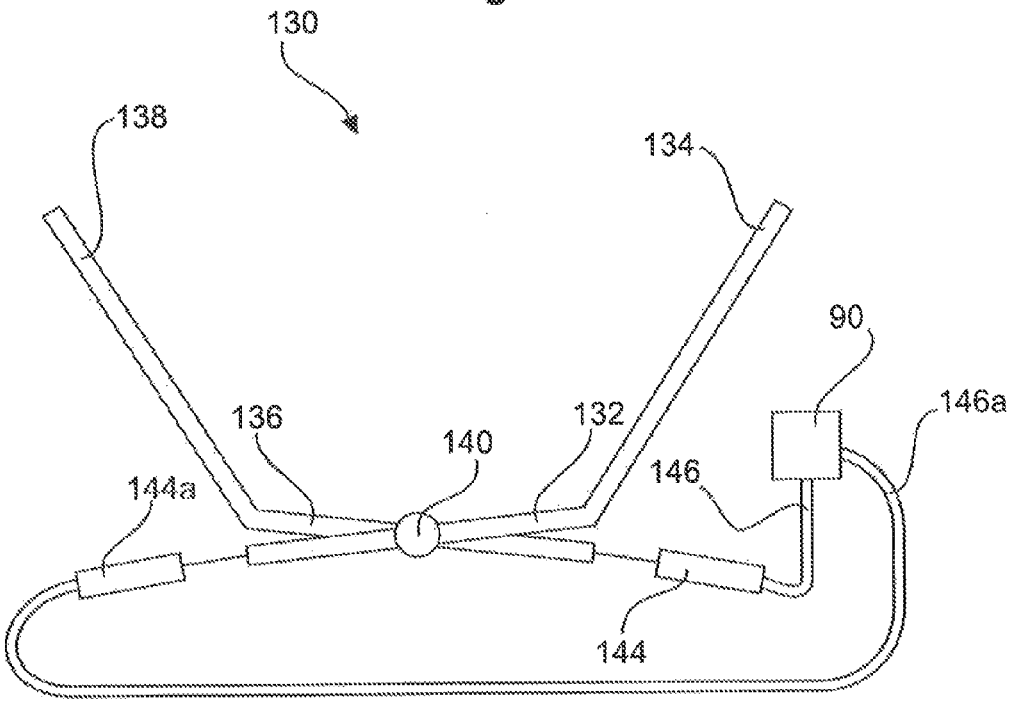
FIG. 6A is a front schematic view of the alignment mechanism of another embodiment of the poultry loader of the present invention.
Figure 6B:
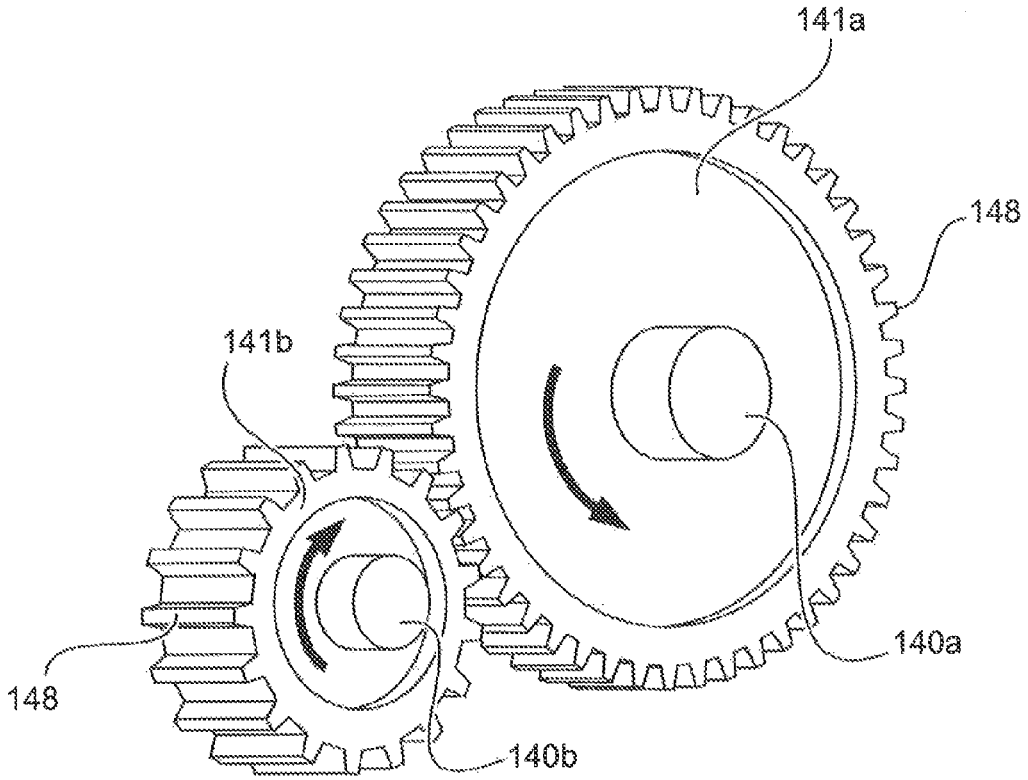
FIG. 6B is a perspective view of a gear arrangement of an embodiment of the alignment mechanism of the poultry loader of the present invention.

Axle 140 preferably contains a ratchet mechanism, so that rotation of first arm 132 about axle 140 causes second arm 136 to rotate in an opposite direction about axle 140. Alternatively, a second air cylinder 144*a* can be mounted on upper frame 28 and connected to first arm 132 and, by a second alignment air feed hose 146*a*, to controller 90, as shown in FIG. 6A. Furthermore, conventional gear and pulley arrangements can be used so that rotation of second arm 136 in a first direction results in rotation of first arm 132. For example, first arm 132 rotates about axle 140*a*, to which is radially attached first gear 141*a*, and second arm 136 rotates about axle 140*b*, to which is radially attached second gear 141*b*, as shown in FIG. 6B. Axles 140*a* and 140*b* are mounted to upper frame 28 adjacent each other, close enough that the teeth 148 of first gear 141 a meshes with second gear 141*b*, as shown in FIG. 6B. Other arrangements can be used as is known in the art.

Figure 4:
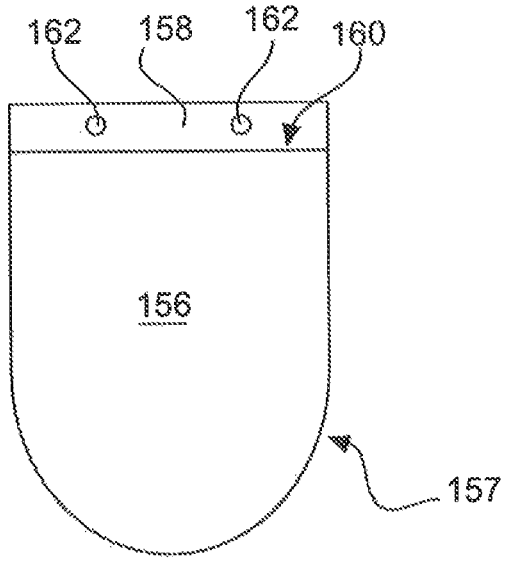
FIG. 4 is a top view of a bag as known in the prior art.
Figure 5:
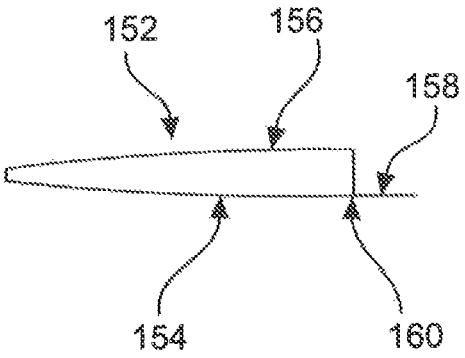
FIG. 5 is a side view of a bag as known in the prior art.

A stack 150 of bags 152 are mounted on bag plate 96. A bag 152 as known in the art is shown in FIGS. 4 and 5. Each bag 152 has a bottom sheet 154, a top sheet 156, and a tab section 158 separated from bottom sheet 154 by perforation line 160. Top sheet 156 is connected to bottom sheet 154 preferably by ultrasonic welding. Tab section 158 has two apertures 162. A wicket extends through apertures 162 of each bag 152 to connect stack 150 to bag plate 96.

Figure 8:
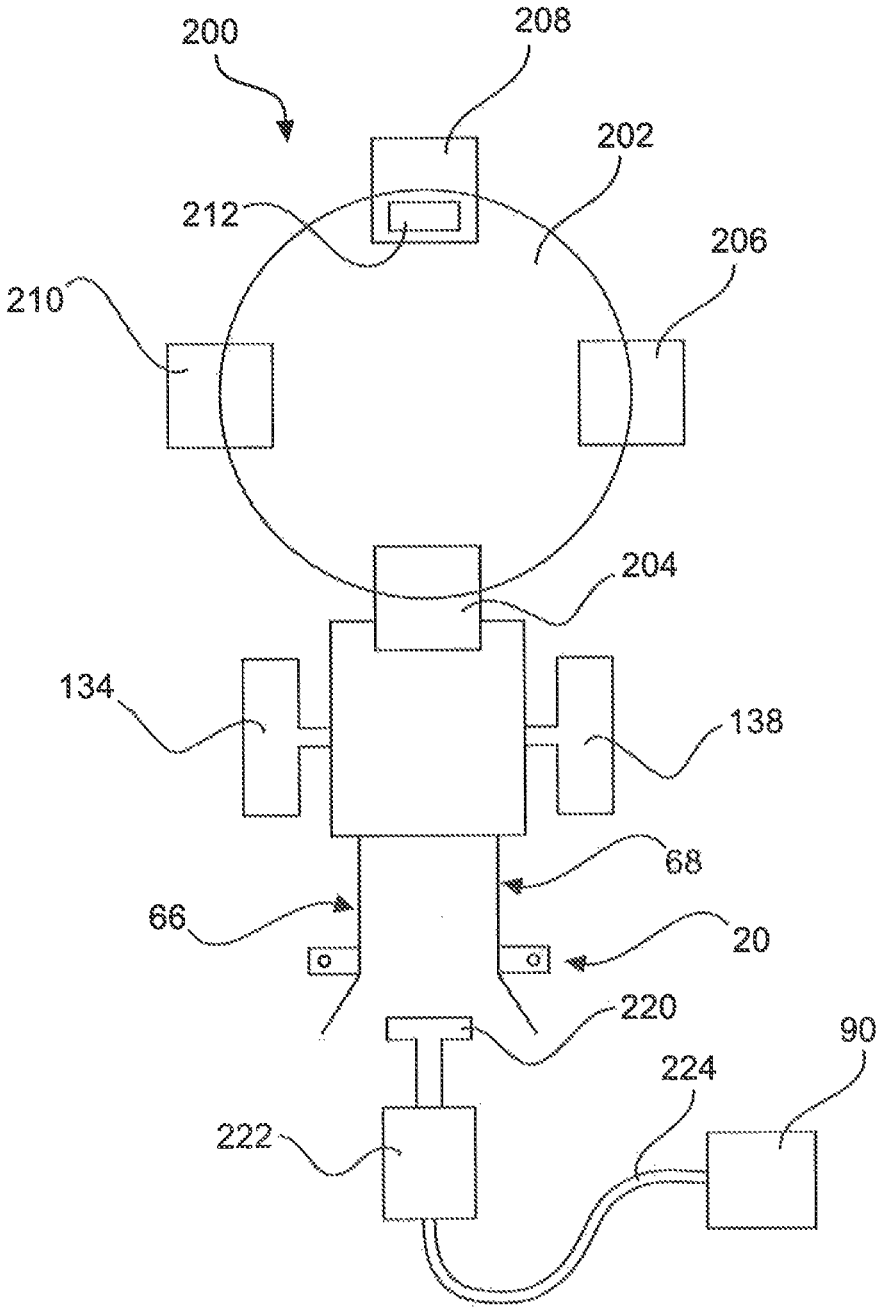
FIG. 8 is a view of one type of textured steel as used in an embodiment of the present invention.
Figure 9:
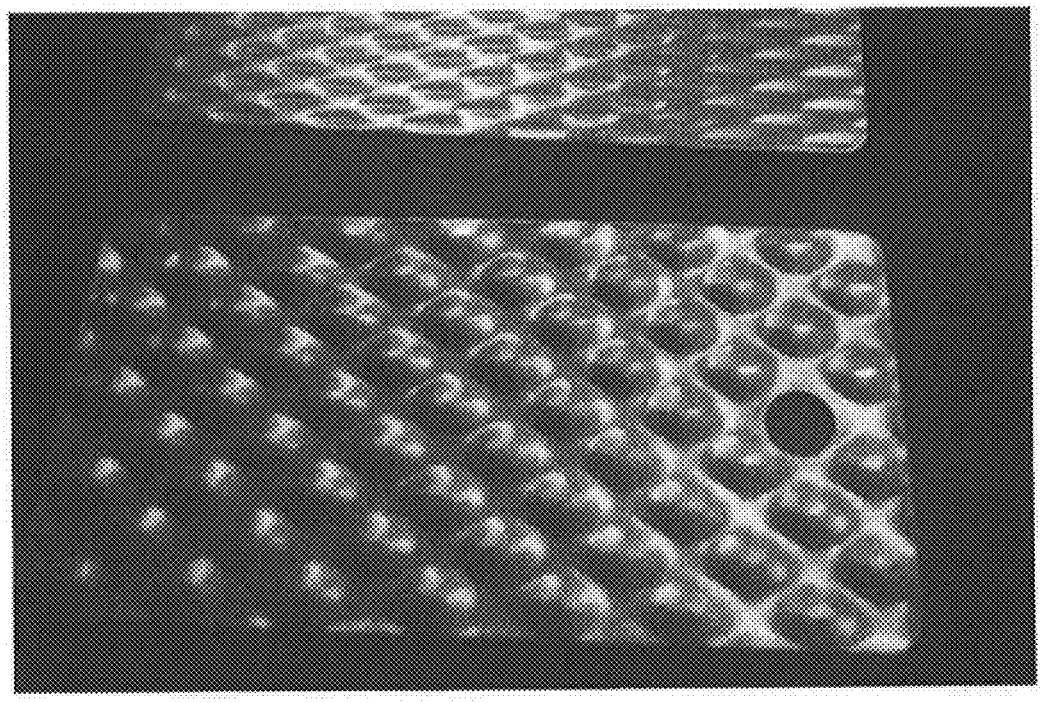
FIGS. 9 and 10 are drawings of other types of textured steel that can be used in embodiments of present invention.
Figure 10:
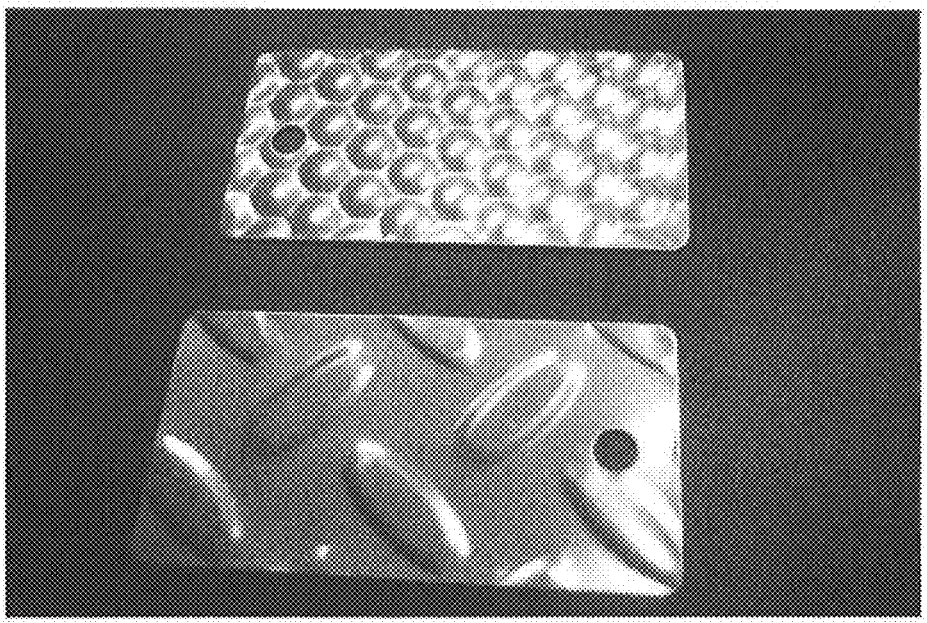

For use in food packaging, all components must meet local or regional requirements for materials. Accordingly, all components described above except air hoses, hose connectors, and air filters are preferably made of stainless steel. All air hoses, hose connectors, and air filters are preferably made of materials approved for use in food packaging applications, such as silicone, glass, or similar materials.

in one aspect of the invention, at least a portion of horns 66, 68 are made of stainless steel, preferably highly polished stainless steel, more preferably textured (or dimpled) highly polished stainless steel, with the dimples on inner surface 72. Preferably, the dimpled or textured stainless steel is diamond-shaped textured stainless steel, such as HS Item Number R813000041, available from McNichols Co., Tampa, Fla., or type 4.WL, available from Mechanical Metals, Newtown, Pa. A representative diamond-shaped texture is shown schematically in FIG. 8. Other textures can be used as well, such as the ones shown, by way of example and not by way of limitation, in FIGS. 9 and 10. The inventor has found that, surprisingly, textured stainless steel has a much lower coefficient of friction with, for example, dry dressed chicken, than does polished stainless steel with dry dressed chicken. By using textured stainless steel for horns 66, 68, loader 20 can be used with either wet or dry chicken.

In another aspect of the invention, at least a portion of inner surface 72 of each of horns 66, 68 is coated with a slippery synthetic substance. Most preferably, the substance is a thermoplastic polymer, preferably polytetrafluoroethylene, most preferably one of the materials sold under the brand name Teflon® by E. I. du Pont de Nemours and Company or its affiliates. Any other slippery substance can be used as well. The use of a slippery synthetic substance will ease bagging of dry poultry. Nevertheless, the apparatus can also be used with wet poultry and therefore will be more useful to users than an apparatus that can only be used with one or the other.

In yet another aspect of the invention, at least a portion of each of horns 66, 68 is made of dimpled steel and at least a portion of inner surface 72 is coated with a slippery synthetic substance as described above.

Controller 90 is preferably an electronic controller having valves for supplying pressurized air to the components of loader 20. Controller 90 is alternatively a manually-operated set of valves.

In use, upper frame 28 is first rotated to the proper angle for the application by raising second end 32 until that angle is reached. Inner telescopic arm 44 is aligned within outer telescopic arm 38 and pin 52 is inserted in an aperture 50 in outer telescopic arm 38 and through a matching aperture 50 in inner telescopic arm 44, locking the two arms 38, 44 together and thereby holding upper frame 28 at the proper angle. A stack 150 of bags 152 is secured to bag plate 96 by wicket 164.

Horns 66, 68 are set at a suitable distance for the material to be packaged. Bolts 78 are loosened, allowing horns 66, 68 to move closer to each other or farther from each other, depending on the position of bolts 78 within elongated aperture 76 of adjustment tabs 72. Bolts 78 are then tightened when horns 66, 68 are at a proper distance for the application, securing horns 66, 68 to pivots 62, 64, closer together for smaller items, such as small poultry, and farther apart for later items, such as turkeys.

An item to be packaged, such as a whole dressed chicken 170, is delivered by a conveyor line or by a hanging line (not shown), and placed manually on top surface 60 between horns 66, 68. Controller 90 releases pressurized air to air jet feed hose 120, causing air jet 98 to puff air at the top bag 152 of stack 150. The puff of air causes bag 152 to open slightly. Controller 90 then releases pressurized air to horn air feed hoses 88, causing pressurized air to flow through ducts 84 in each horn 66, 68. This latter flow of air causes bag 152 to open to its full extent.

Figure 7:
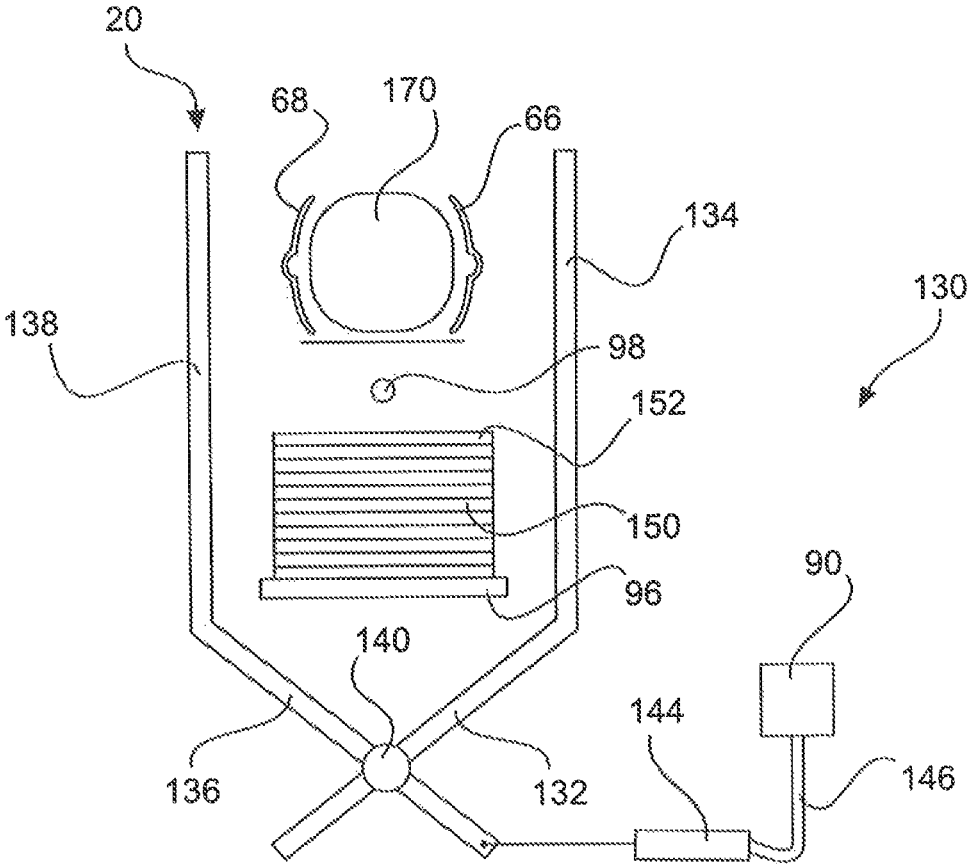
FIG. 7 is a front schematic view of the alignment mechanism of the poultry loader of FIG. 1 in a second position.

Controller 90 then releases air to air cylinder 144, causing it to stroke forward, pushing first arm 132 away and rotating first arm 132 about axle 140, causing first panel 134 to move from its first position, as shown in FIG. 6, to its second position, as shown in FIG. 7. Second arm 136 simultaneously rotates about axle 140, causing second panel 138 to move from its first position, as shown in FIG. 6, to its second position, as shown in FIG. 7. As can be seen from FIGS. 6 and 7, in the first position, panels 134, 138 are remote from bag plate 96 and in the second position, panels 134, 138 are adjacent to bag plate 96.

Since upper frame 28 is angled, chicken 170 slides down top surface 60 and into open bag 152, assisted, perhaps, by an operator. Chicken 170 is restrained between first panel 134 and second panel 138 and accordingly must move in a straight line into bag 152. Once chicken 170 is completely within bag 152, controller 90 directs air to cause air cylinder 144 to retract, causing first arm 132 and second arm 136 to rotate back about axle 140 and return, to the first position shown in FIG. 6. Bag 152 is removed from stack 150. Since wicket 164 holds bag 152 to stack 150, bag 152 tears at perforation line 160, leaving tab section 158 attached. The operator then closes bag 152 by clipping or similar means.

Figure 11:
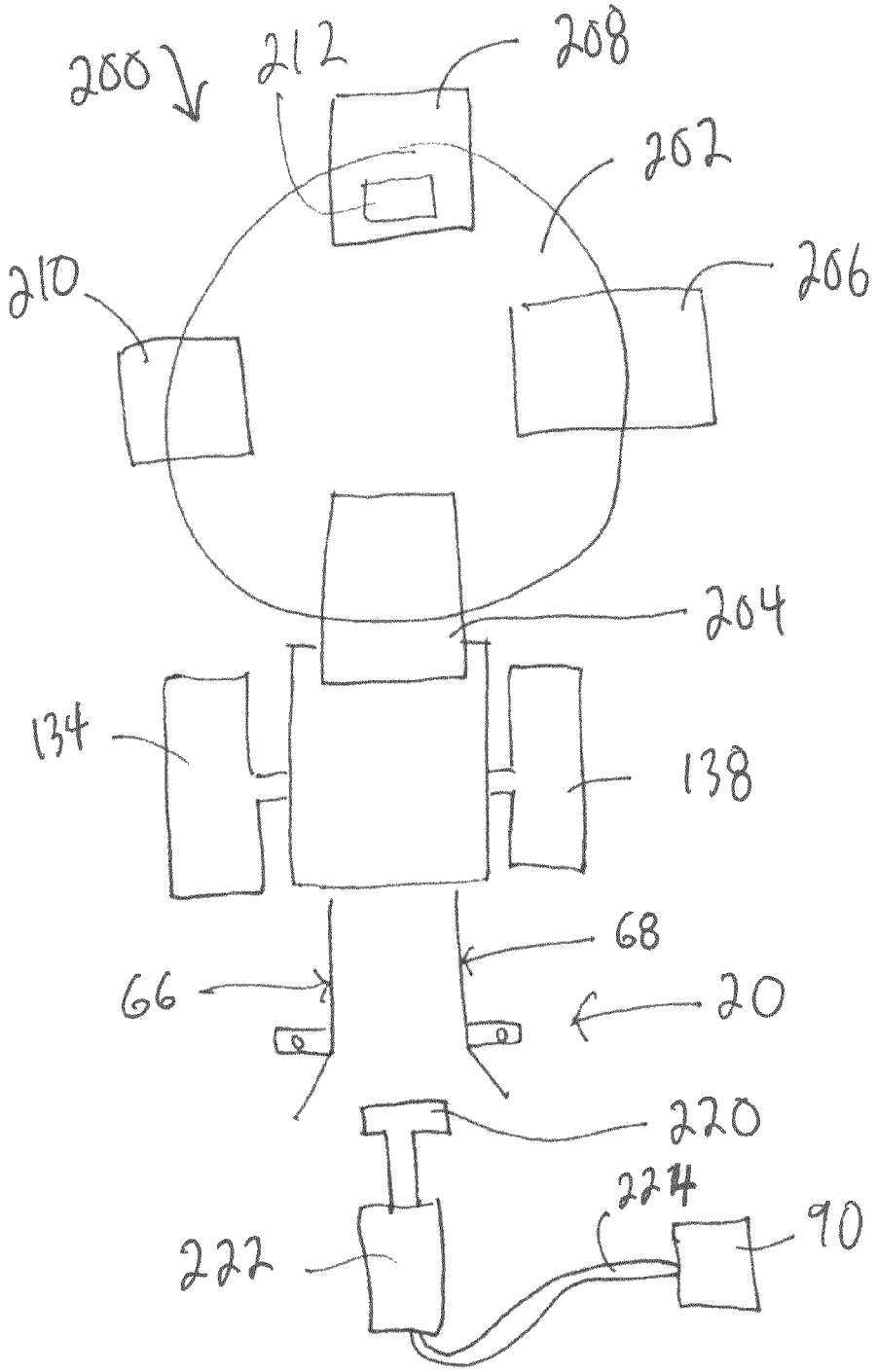
FIG. 11 is a diagrammatic view of an automated loading system of an embodiment of the present invention.

In some applications, loader 20 is used in an automated operation, as shown in FIG. 11. Automated loading system 200 has a rotating table 202 with four stations 204, 206, 208, and 210. Loader 20 is placed at a filling station 204. When a chicken is fully within bag 152 on table 202, table 202 rotates 90 degrees. Bag 152 is then at holding control station 206, where bag 152 is inspected, either manually or electronically using optical methods, for proper bagging. If, for example, a leg of chicken 170 is sticking out of bag 152, system 200 stops until that situation is remedied. Simultaneously, loader 20 to placing another chicken 170 into the next bag 152 in stack 150.

Table 202 then rotates another 90 degrees to bring bag 152 to finish station 208, where clipper 212 is located. Clipper 212 is a conventional clipper, such as a Model EZ P 700 or a Model SCD BY, clippers sold by Precitec of Mundelein, Ill., U.S., or a similar clipper. At finishing station 208, bag 152 is clipped and the tail of bag 152 is cut, either manually or automatically. Table 202 then rotates another 90 degrees to bring bag 152 to drop station 210, where packaged chicken 170 is released for delivery. As table 202 rotates, all four stations 204, 206, 208, and 210 are simultaneously operating to place a chicken 170 in a hag 152, inspect the bag 152 for proper packaging, finishing the packaging operation by clipping and cutting, and dropping the packaged chicken 170 for delivery.

In some applications, a ram 220 is used to push chicken 170 into bag 152. Preferably, ram 220 is mounted on an air cylinder 222, which is connected by a ram air feed hose 224 to controller 90, which causes ram 220 to stroke forward and to retract in a conventional manner. Ram 220 is shown in diagrammatic view in FIG. 2 and in FIG. 11.

In another aspect of the invention, horns 66, 68 comprise a funnel horn. In this aspect, upper shoulders 80 of each horn 66, 68 horn connect to each other and lower shoulders 82 of each horn 66, 68 connect to each other.

While preferred embodiments of the present invention are shown and described, it is envisioned that those skilled in the art may devise various modifications of the present invention without departing from the scope of the appended claims.

We claim:

1. A loader comprising:

a frame having an upper surface;

a pair of horns adjustably connected to the upper surface, each horn comprising an upper shoulder, a lower shoulder, and an air duct between the upper shoulder and the lower shoulder;

a pair of air hoses connecting each air duct to a controller, the controller being connected to a pressurized air supply; and an alignment mechanism comprising:

an axle mounted to the frame, a first arm connected to a first panel, the first arm rotatably connected to the axle;

a second arm connected to a second panel, the second arm rotatably connected to the axle;

a gear mechanism connected to the axle, to the first arm, and to the second arm, the gear mechanism configured to rotate the second arm in a direction opposite to a direction of rotation of the first arm;

and a dual-action cylinder connected to at least one of the first arm and the second arm.

2. The loader of claim 1, wherein the frame comprises a lower frame and an upper frame, the upper frame articulating with respect to the lower frame, and the upper surface is on the upper frame.

3. The loader of claim 1, wherein the axle comprises a first axle and a second axle and the gear mechanism comprises a first gear attached to the first axle and a second gear attached to the second axle, the first gear and the second gear each having a plurality of teeth, the teeth of the first gear meshing with the teeth of the second gear.

4. The loader of claim 1, further comprising a ram mounted to the frame.

5. The loader of claim 1, wherein the pair of horns comprise a funnel horn.

6. The loader of claim 1, wherein each horn has an inner surface and at least a portion of the inner surface comprises dimples.

7. The loader of claim 1, wherein each horn has an inner surface and at least a portion of the inner surface is coated with a slippery synthetic substance.

8. The loader of claim 7, wherein the substance comprises a thermoplastic polymer.

9. The loader of claim 8, wherein the thermoplastic polymer comprises polytetrafluoroethylene.

10. An automated loading system comprising a rotating table comprising four stations spaced apart on the periphery of the table, the four stations comprising:

a first loading station comprising the loader of claim 1;

a second inspection station;

a third clipping station comprising a clipper; and a fourth unloading station.

11. The automated loading system of claim 10, further comprising a ram at the first loading station.

12. A loader comprising:

a frame having an upper surface;

a pair of horns adjustably connected to the upper surface, each horn comprising an upper shoulder, a lower shoulder, and an air duct between the upper shoulder and the lower shoulder;

a pair of air hoses connecting each air duct to a controller, the controller being connected to a pressurized air supply; and an alignment mechanism comprising:

an axle mounted to the frame, a first arm rotatably connected to the axle;

a first panel connected to the first arm;

a second arm rotatably connected to the axle;

a second panel connected to the second arm;

a first dual-action cylinder connected to the first arm; and a second dual-action cylinder connected to the second arm.

13. The loader of claim 12, wherein the frame comprises a lower frame and an upper frame, the upper frame articulating with respect to the lower frame, and the upper surface is on the upper frame.

14. The loader of claim 12, further comprising a ram mounted to the frame.

15. The load of claim 12, wherein the pair of horns comprise a funnel horn.

16. The loader of claim 12, wherein each horn has an inner surface and at least a portion of the inner surface comprises dimples.

17. The loader of claim 12, wherein each horn has an inner surface and at least portion of the inner surface is coated with slipper synthetic substance.

18. The loader of claim 12, wherein the substance comprise a thermoplastic polymer.

19. The loader of claim 12, wherein the thermoplastic polymer comprises polytetrafluoroethylene.

20. An automated loading system comprising a rotating table comprising four stations spaced apart on the periphery of the table, the four stations comprising:

a first loading station comprising the loader of claim 12;

a second inspection station;

a third clipping station comprising a clipper; and a fourth unloading station.

* * * * *